US009538609B2

(12) United States Patent
Varga et al.

(10) Patent No.: US 9,538,609 B2
(45) Date of Patent: Jan. 3, 2017

(54) OPTOELECTRONIC DEVICE

(75) Inventors: Horst Varga, Lappersdorf (DE); Ralph Wirth, Lappersdorf (DE)

(73) Assignee: OSRAM Opto Semiconductors GmbH (DE)

( * ) Notice: Subject to any disclaimer, the term of this patent is extended or adjusted under 35 U.S.C. 154(b) by 759 days.

(21) Appl. No.: 13/637,438

(22) PCT Filed: Mar. 30, 2011

(86) PCT No.: PCT/EP2011/054960

§ 371 (c)(1),
(2), (4) Date: Dec. 3, 2012

(87) PCT Pub. No.: WO2011/121046

PCT Pub. Date: Oct. 6, 2011

(65) Prior Publication Data

US 2013/0088166 A1 Apr. 11, 2013

(30) Foreign Application Priority Data

Mar. 31, 2010 (DE) ..... 10 2010 013 493

(51) Int. Cl.
*H05B 37/02* (2006.01)
*H05B 33/08* (2006.01)

(52) U.S. Cl.
CPC ..... *H05B 37/02* (2013.01); *H05B 33/0872* (2013.01)

(58) Field of Classification Search
None
See application file for complete search history.

(56) References Cited

U.S. PATENT DOCUMENTS

| | | | | |
|---|---|---|---|---|
| 3,755,679 | A | 8/1973 | Otsuka | |
| 6,498,440 | B2 | 12/2002 | Stam et al. | |
| 7,088,334 | B2 * | 8/2006 | Adachi et al. | 345/102 |
| 8,207,691 | B2 * | 6/2012 | Slot | H05B 33/0818 315/210 |
| 2001/0033258 | A1 | 10/2001 | Berryman et al. | |
| 2002/0047624 | A1 | 4/2002 | Stam et al. | |
| 2004/0183475 | A1 | 9/2004 | Boulouednine et al. | |
| 2005/0156103 | A1 * | 7/2005 | May et al. | 250/228 |

(Continued)

FOREIGN PATENT DOCUMENTS

| | | |
|---|---|---|
| CN | 101009080 | 8/2007 |
| CN | 101010649 | 8/2007 |

(Continued)

OTHER PUBLICATIONS

English translation of corresponding Office Action of CN Application No. 201180018060.0 dated Dec. 31, 2014.

*Primary Examiner* — Douglas W Owens
*Assistant Examiner* — James H Cho
(74) *Attorney, Agent, or Firm* — DLA Piper LLP

(57) ABSTRACT

An optoelectronic device that radiates mixed light including a first semiconductor light source which radiates light in a first wavelength range at a first intensity, a second semiconductor light source which radiates light in a second wavelength range at a second intensity, a third semiconductor light source which radiates light in a third wavelength range at a third intensity, a resistance element having a temperature-dependent electrical resistance, and a semiconductor light source control element that controls the intensity of the third semiconductor light source.

21 Claims, 4 Drawing Sheets

(56) References Cited

U.S. PATENT DOCUMENTS

| | | | | |
|---|---|---|---|---|
| 2006/0175985 | A1* | 8/2006 | Huynh et al. | 315/312 |
| 2007/0109763 | A1* | 5/2007 | Wolf et al. | 362/86 |
| 2007/0171159 | A1 | 7/2007 | Lee | |
| 2009/0009100 | A1 | 1/2009 | Rooymans | |
| 2009/0091265 | A1 | 4/2009 | Song et al. | |
| 2009/0146584 | A1* | 6/2009 | Ye | H05B 33/0818 315/294 |
| 2010/0026191 | A1 | 2/2010 | Radermacher et al. | |
| 2011/0115406 | A1* | 5/2011 | Wang et al. | 315/294 |
| 2011/0291129 | A1 | 12/2011 | Wirth | |

FOREIGN PATENT DOCUMENTS

| | | | |
|---|---|---|---|
| DE | 103 04 875 | A1 | 8/2004 |
| DE | 10 2004 057 379 | B3 | 8/2006 |
| DE | 10 2008 025 865 | A1 | 12/2009 |
| DE | 10 2008 057 347 | A1 | 5/2010 |
| WO | 99/39319 | | 8/1999 |

* cited by examiner

OPTOELECTRONIC DEVICE

RELATED APPLICATIONS

This is a §371 of International Application No. PCT/EP2011/054960, with an international filing date of Mar. 30, 2011 (WO 2011/121046 A1, published Oct. 6, 2011, which is based on German Patent Application No. 10 2010 013 4933 filed Mar. 31, 2010, the subject matter of which is incorporated herein by reference.

TECHNICAL FIELD

This disclosure relates to an optoelectronic device for radiating mixed light.

BACKGROUND

To generate mixed light, that is to say non-monochromatic light and in this case, for example, white light, it is customarily possible, when light-emitting diodes (LEDs) are used, to employ LEDs that emit in different colors and/or a plurality of luminescent materials. To generate white light, for example, spectral components in the yellow-green and the red wavelength ranges which are radiated by different LEDs can be superimposed.

What is challenging, in addition to meeting optical requirements, such as, for example, the mixing of light emitted by different LED chips, is also the stabilization of the color location, for example, of the white point in the case of white light, with respect to temperature. This relates, for example, to different temperature dependencies of the chip technologies involved. A stabilizing element is shown in the non-prior-published DE 10 2008 057 347.7.

Also of interest, in addition to the stabilization of the color location, is the possibility of controlling the color temperature (CCT) of such a light source, for example, to vary between warm-white light and cold-white light. Typical implementations of color-temperature-controllable light sources have an optical and/or thermal sensor, a microcontroller and a plurality of LED drivers to control the LEDs. For the compensation of thermal effects, typical LED characteristics are stored in the microcontroller.

The problem posed is that of defining a color-temperature-controllable and color-location-stabilized light source of simple construction.

SUMMARY

We provide an optoelectronic device that radiates mixed light including a first semiconductor light source having a first light-emitting diode which, in operation, radiates light in a first wavelength range at a first intensity, the first wavelength range and/or the first intensity having a first temperature dependency, a second semiconductor light source having a second light-emitting diode which, in operation, radiates light in a second wavelength range at a second intensity, the first and the second wavelength ranges being different from one another and the second wavelength range and/or the second intensity having a second temperature dependency which is different from the first temperature dependency, a third semiconductor light source having a third light-emitting diode which, in operation, radiates light in a third wavelength range at a third intensity, a resistance element having a temperature-dependent electrical resistance, and a semiconductor light source control element that controls the intensity of the third semiconductor light source, wherein a parallel circuit is formed with a first series circuit having the resistance element and the first semiconductor light source in a first branch of the parallel circuit, the second semiconductor light source in a second branch of the parallel circuit and a second series circuit having the third semiconductor light source and the semiconductor light source control element in a third branch of the parallel circuit.

DETAILED DESCRIPTION

Figure 1:
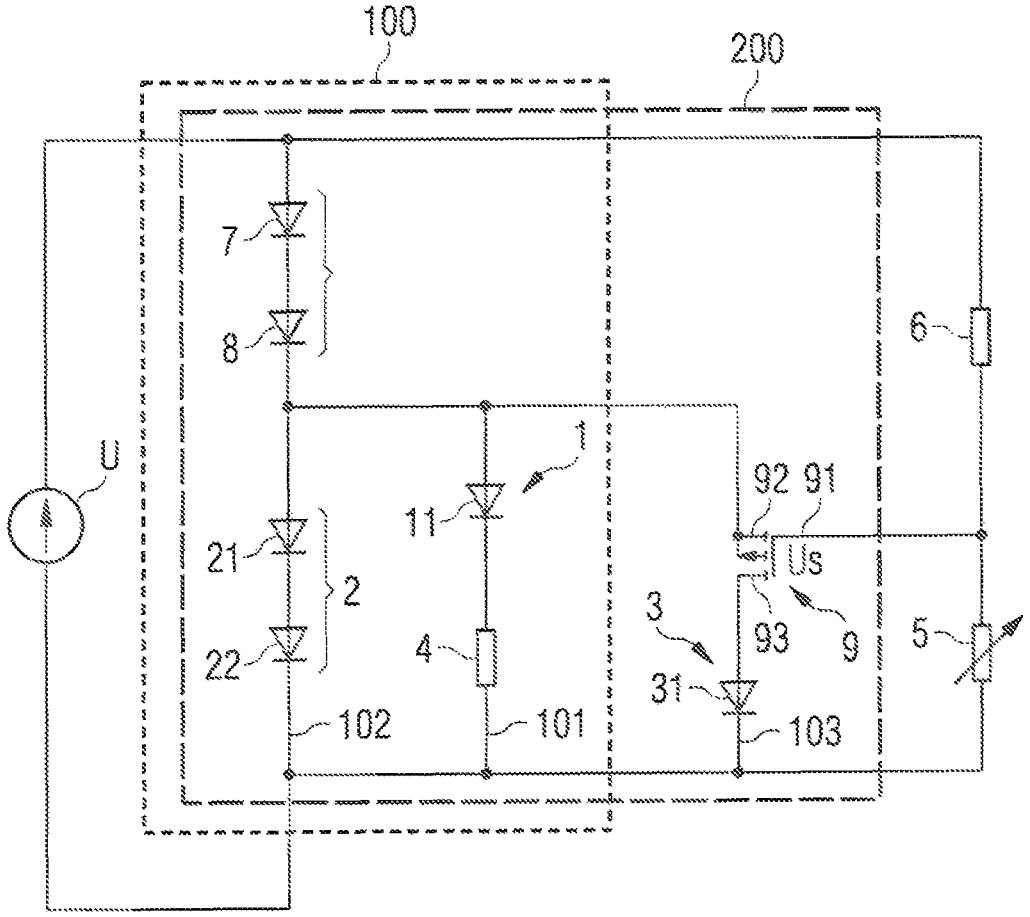
FIG. 1 is a circuit diagram of an optoelectronic device for radiating mixed light.

We provide an optoelectronic device comprising:

a first semiconductor light source having a first light-emitting diode which, in operation, radiates light in a first wavelength range at a first intensity, the first wavelength range and/or the first intensity having a first temperature dependency, a second semiconductor tight source having a second light-emitting diode which, in operation, radiates light in a second wavelength range at a second intensity, the first and the second wavelength ranges being different from one another and the second wavelength range and/or the second intensity having a second temperature dependency which is different from the first temperature dependency, a third semiconductor light source having a third light-emitting diode which, in operation, radiates light in a third wavelength range at a third intensity, a resistance element having a temperature-dependent electrical resistance, and a semiconductor light source control element for controlling the intensity of the third semiconductor light source, there being connected in a parallel circuit: a first series circuit having the resistance element and the first semiconductor light source in a first branch of the parallel circuit, the second semiconductor light source in a second branch of the parallel circuit and a second series circuit having the third semiconductor light source and the semiconductor light source control element in a third branch of the parallel circuit.

The resistance element brings about stabilization of the temperature because it counteracts the different temperature dependencies of the first and second semiconductor light sources, from which the temperature-dependent color location shift originates. The intensity of the third semiconductor light source is controllable by the semiconductor light source control element, bringing about a change in the color temperature of the mixed light. In the event of a change in temperature, the set color temperature of the mixed light changes by a smaller amount than would be the case without temperature compensation by the resistance element. In normal operation, an increase in temperature occurs, for example, when the device heats up to its operating temperature after being switched on.

The optoelectronic device enables the physical properties of the semiconductor light sources to be compensated by a suitably selected temperature-dependent resistance element. Such a circuit arrangement has a simpler structure than conventional circuit arrangements, because only one LED driver or semiconductor light source control element, rather than several, needs to be provided. A microcontroller is unnecessary.

"Light" can denote, in particular, electromagnetic radiation having one or more wavelengths or wavelength ranges from an ultraviolet to an infrared spectral range. In particular, right can be visible light and comprise wavelengths or wavelength ranges from a visible spectral range of approximately 350 nm to approximately 800 nm. The visible light can be characterizable by its color location with x and y color location coordinates in accordance with the known so-called "CIE 1931 color location diagram" or "CIE standard chromaticity diagram."

"White light" or "light having a white luminous impression or color impression" can be used to denote light having a color location that corresponds to the color location of a Planckian black-body radiator or that differs from the color location of a Planckian black-body radiator by less than 0.1 and preferably by less than 0.05 in the x and/or y color location coordinates. Furthermore, a luminous impression designated here and hereinbelow as a white luminous impression can be brought about by light which has a color rendering index (CRI), which is known, of greater than or equal to 60, preferably greater than or equal to 70 and especially preferably greater than or equal to 80.

Furthermore, the term "warm-white" can be used to denote a luminous impression having a color temperature of less than or equal to 5500 K. The term "cold-white" can be used to denote a white luminous impression having a color temperature greater than 5500 K. The region around 5500 K can be denoted as neutral-white. The term "color temperature" can denote the color temperature of a Planckian black-body radiator or also the correlated color temperature (CCT) in the case of a white luminous impression in the sense described above which can be characterised by color location coordinates that differ from the color location coordinates of the Planckian black-body radiator.

Different luminous impressions by light of differently perceivable color locations can be brought about, in particular, by first and second wavelength ranges that are different from one another. A first and a second wavelength range can be denoted as being different when, for example, the first wavelength range has at least one spectral component that is not present in the second wavelength range. The first and second wavelength ranges bring about respective luminous and color impressions having different x coordinates and/or different y coordinates in the CIE standard chromaticity diagram.

The resistance element can be in thermal contact with the first and/or the second and/or the third semiconductor light source(s) and thus with the first and/or second and/or third light-emitting diode(s) (LED). That can mean that, in the event of a change in the temperature of the semiconductor light sources, the temperature of the resistance element changes to the same extent as the latter, and vice versa.

As a result of the different first and second temperature dependencies of the first and second intensities and/or of the first and second wavelength ranges, the luminous impressions of the semiconductor light sources can change differently from one another in dependence upon the ambient and operating temperatures. Accordingly, in the case of uncontrolled superimposition of the light of the semiconductor light sources, therefore, the luminous impression of the superimposition, that is to say of the mixed light, can likewise change. In the case of our optoelectronic device it can be possible, with the resistance element, to generate a mixed light having as low as possible a temperature dependency in respect of its color location.

Depending upon configuration and choice of material, the first temperature dependency can be less than the second temperature dependency. That means that, as the temperature rises, for example, the first intensity of the first semiconductor light source changes to a lesser extent than does the second intensity of the second semiconductor light source. In that case the resistance element is a resistance element having a positive temperature coefficient, which means that the electrical resistance of the resistance element increases as the temperature rises and the resistance element is configured as a cold conductor or PIC ("positive temperature coefficient") resistance element. If the temperatures of the first and second semiconductor light sources rise, for example, as a result of a rise in ambient temperature, then in the afore-mentioned case the second intensity decreases to a greater extent than does the first intensity. That means that the color location of the mixed light would shift towards the color location of the first semiconductor light source. In the resistance element configured as a PTC element, however, the temperature simultaneously also rises and therefore so does also the electrical resistance so that the current flowing through the first series circuit and therefore through the first semiconductor light source is reduced in comparison with the current flowing through the second semiconductor light source so that the purely temperature-induced change in the first and second intensities can be counteracted.

As an alternative thereto, the first temperature dependency can be greater than the second temperature dependency. In that case the resistance element is a resistance element having a negative temperature coefficient, which means that the electrical resistance of the resistance element decreases as the temperature rises and the resistance element is configured as a hot conductor or NTC ("negative temperature coefficient") resistance element. As a result, as in the previous case, the purely temperature-induced change in the first and second intensities can likewise be counteracted in that, in the event of a rise in temperature, the current flowing through the series circuit and therefore through the first semiconductor light source is increased in comparison with the current flowing through the second semiconductor light source.

In particular, the resistance element can have a temperature-dependent electrical resistance which is matched to the first and second temperature dependencies of the first and second semiconductor light sources. This can mean, in particular, that the resistance element has no switching behavior and that the electrical resistance does not change abruptly in a temperature range of from −40° C. to 125° C. Preferably, the electrical resistance of the resistance element varies continuously in a temperature range of higher than or equal to −40° C. and lower than or equal to 125° C., which means that, depending upon whether the resistance element is configured as a cold or hot conductor, the electrical resistance rises or falls, respectively, with a substantially constant temperature dependency. The resistance element preferably has a linear or approximately linear resistance/temperature dependency.

In one configuration, the semiconductor light source control element in a first state substantially blocks flow of current through the third branch and in a second state substantially allows flow of current through the third branch.

In other words: in the first state the supply of current to the third semiconductor light source is interrupted or at least reduced such that it emits no light; in the second state it emits light. By switching the third semiconductor light source on and off, the color temperature of the mixed light is changed.

In a second configuration, it is possible to switch over discretely between the first and second states. In this configuration the semiconductor light source control element serves as a switch with which the third semiconductor light source is switched on and off to switch it back and forth between two color temperatures of the mixed light.

In an alternative configuration, the flow of current through the third branch is continuously changeable between the first and second states. This allows the color temperature to change continuously.

Advantageously, the semiconductor light source control element comprises a transistor to which a control voltage can be applied. The transistor controls the flow of current through the third branch and, accordingly, the intensity of the light emitted by the third semiconductor light source, in dependence upon the control voltage applied.

The transistor can be in the form of an N-channel MOSFET or a P-channel MOSFET, allowing degrees of freedom in the design of the circuit.

To change the control voltage continuously, a potentiometer can be provided to set the control voltage.

Advantageously, a voltage divider is provided to set the control voltage. The control voltage applied to the transistor can drop across a resistor of the voltage divider. In the case of a voltage divider having a potentiometer, the voltages dropped across resistors of the voltage divider can be changed and, accordingly, the control voltage can also be changed, by a change in the resistance of the potentiometer.

In one configuration, the mixed light is warm-white in one of the states and cold-white in the other state. In other words: the light emitted by the device can be switched between cold white and warm white to adapt the illumination.

For example, in the case of a white-light-emitting device having a cold-white first semiconductor light source and a red-light-emitting second semiconductor light source, a third semiconductor light source can be provided which is suitable for emitting blue light. When the third semiconductor light source emits no light, the mixed light is warm-white. When the third semiconductor light source emits light, the mixed light is colder in terms of its color temperature.

In one configuration, the device is in the form of a module so that the elements of the device are arranged in a housing. In one configuration, two connections for application of a supply voltage are provided. In a different example of the module, in addition to the connections for application of the supply voltage there is also provided at least one connection for application of a potential for actuating the semiconductor light source control element.

Our devices will be explained below on the basis of examples and referring to in the Drawings.

FIG. 1 shows a circuit diagram or a circuit arrangement of an example of an optoelectronic device for radiating mixed light, that is to say a light source having a first semiconductor light source 1, a second semiconductor light source 2 and a third semiconductor light source 3.

The first semiconductor light source 1 comprises a first LED 11, which radiates light in a first, cold-white wavelength range. Radiation of light in the yellow-green range is also a possibility. The second semiconductor light source 2 comprises a series circuit of two second LEDs 21, 22, which radiate red light in a second wavelength range. The third semiconductor light source 3 comprises a third LED, which radiates blue light in a third wavelength range.

Furthermore, further LEDs 7, 8 are provided, which radiate light in the first wavelength range. The provision of the further LEDs 7, 8 is optional. It is also possible for no LEDs, one LED or more than two LEDs to be provided. Their luminous impression is not limited to white.

Also provided are first, second and third resistance elements 4, 5, 6. The first resistance element 4 is temperature-dependent and has a positive temperature coefficient so that its resistance increases with rising temperature. In other words, the first resistance element 4 is a PTC resistance element. A second resistance element 5 has a variable resistance. That resistance element is in the form of a potentiometer. The resistance of the third resistance element 6 is fixed.

The circuit arrangement further comprises a MOSFET, which serves as semiconductor light source control element 9, with a gate terminal, a source terminal and a drain terminal 91, 92, 93.

The first, second and third semiconductor light sources 1, 2, 3, the resistance elements 4, 5, 6 and the semiconductor light source control element 9 configured as a MOSFET are connected as follows: in a first branch 101, the first semiconductor light source 1 is connected in series with the first resistance element 4. In a second branch 102 there is arranged the second semiconductor light source 2 with the two LEDs 21, 22, and in a third branch 103, the semiconductor light source control element 9 configured as a MOSFET is connected in series with the third semiconductor light source 3, the drain terminal 93 being connected to the third LED 31. The first, second and third branches 101, 102, 103 are connected in parallel.

The two further LEDs 7, 8 are connected in series with the parallel circuit. In parallel with that series circuit with the further LEDs 7, 8 and the parallel circuit there is connected a series circuit having the second and third resistance elements 5, 6. The second and third resistance elements 5, 6 serve as voltage dividers. A control voltage applied to the gate terminal 91 of the semiconductor light source control element 9 configured as a MOSFET is tapped between the second and third resistance elements 5, 6.

Alternatively to the combination having the white-emitting first semiconductor light source 1, the red-emitting second semiconductor light source 2 and the blue-emitting third semiconductor light source 3, which is described herein purely by way of example, it is also possible to use any other combination of semiconductor light sources having emission spectra in other wavelength ranges if it is desirable for the mixed light to give different color and luminous impressions. In particular, the color of the third semiconductor light source 3 is not limited to blue.

The mixed light of the first and second semiconductor light sources 1, 2, without the contribution of the third semiconductor light source 3, is warm-white. As the intensity of the third LED 3, which emits blue light, increases, the color temperature of the mixed light becomes increasingly colder.

The use of red LEDs, blue LEDs and white (for example phosphor-converted blue) LEDs provides an efficient way of creating a light source in which the color temperature is controllable along the white curve, this being of great interest in respect of SSL (Solid-State-Lighting) applications. Such applications are able to utilize the potential of the LEDs for color-controllable light, sources.

The color location stabilization of white and red LEDs 11, 21 is advantageous because, in the event of an increase in temperature, the emitted light of the red LEDs 21 is shifted to a greater extent into the longer wavelength range and at the same time they lose efficiency or intensity to a greater extent than does the light of the white LEDs 11, 7, 8 and the blue LED 31. The white LEDs change their color location on account of the fall in phosphor efficiency as the temperature rises. A control is achieved that reduces the color location shift with the temperature dependent first resistance element 3.

The frame 100 identifies the white-point-stabilizing element of the circuit arrangement of the optoelectronic device, which element comprises the first and second semiconductor light sources 1, 2 and the PTC resistance element 4. The mode of operation of this stabilizing element is explained below.

At low ambient and operating temperatures, more current flows via the PTC resistance element 4 and less through the second semiconductor light source 2. At high temperatures, given a constant total flow of current or constant voltage, the current balance shifts towards the second semiconductor light source 2 since, as a result of a temperature-induced increase in the electrical resistance of the FTC resistance element 4, more current flows through the second semiconductor light source 2.

If the second semiconductor light source 2 is connected in parallel only with the PTC resistance element 4 alone, however, the full voltage dropped across the second semiconductor light source 2 would drop also across the resistance element 4, leading to high ohmic losses in the PTC resistance element 4 and accordingly to an ineffective device. As a result of the additional series circuit formed by the resistance element 4 with the first semiconductor light source 1, the loss of power at the PTC resistance element 4 can be reduced, resulting in substantial increase in the efficiency of the optoelectronic device. Simultaneously with the increase in the current in the second semiconductor light source 2, in the event of a rise in the ambient temperature the current flowing through the first semiconductor light source 1 is reduced by the PTC resistance element 4, so that in comparison with a constant operating current for the first semiconductor light source 1 the current balance between the first and second semiconductor light sources 1, 2 can be achieved by a comparatively small increase in current in the second semiconductor light source 2. This, in turn, also has the consequence that current-induced self-heating effects in the second semiconductor light source 2 can be kept comparatively low, resulting in a smaller shift in the wavelengths of the light emitted by the second LEDs 21, 22 than would be possible in the case of solely controlling the operating current of the second semiconductor light source 2.

As an alternative to the example described and also to the examples below, the PTC resistance element 4 can also be in the or form of an NTC element if the first and second semiconductor light sources 1, 2 are configured such that the first temperature dependency of the first intensity is greater than the second temperature dependency of the second intensity.

The use of a PTC resistance element (or an NTC resistance element) in the current path brings about stabilization of the White point. The controllable semiconductor light source 3 in the third path broadens this principle and enables a light source controllable between cold white and warm white to be stabilized.

The third branch 103 having the third LED 31 can in a first state be substantially disabled by the semiconductor light source control element 9 configured as a MOSFET so that the third LED 31 radiates no light. In that case, the mixed light of the light source is warm-white. In a second state, the third branch 103 is enabled by the semiconductor light source control element 9 configured as a MOSFET so that the third LED 31 radiates light. Disabling/enabling of the third branch 103 is effected in dependence upon the control voltage Us applied to the semiconductor light source control element 9 configured as a MOSFET. Enabling can also be partially effected and takes place at the expense of the other branches 101, 102, because the current then flows via three branches 101, 102, 103. On enabling, the mixed light becomes colder.

The voltage divider having the second and third resistance elements 5, 6 sets the control voltage Us for the semiconductor light source control element 9 configured as a MOSFET. The second resistance element 5, which is in the form of a potentiometer, allows the control voltage to be changed, because a change in the resistance of the potentiometer 5 brings about a change in the voltage ratio between the voltages applied across the resistance elements 5, 6 and accordingly a change in the control voltage Us.

That circuit arrangement enables the light source that is controllable between cold white and warm white to be stabilized by the PTC resistance element 4. In an alternative example, an NTC resistance element (not described) can be provided for that purpose. This requires only one LED driver, in this case the semiconductor light source control element 9 configured as a MOSFET, but no microcontroller or further sensor. The color temperature can be set solely via the control voltage Us.

In the ease of the temperature-dependent change in the resistance element 4, the current changes not only in the first and second branches 101, 102, but also, if enabled, in the third branch 103. However, the compensation is concentrated on the second LEDs 21, 22 which differ substantially from the other LEDs 11, 31, 8, 7 in terms of their temperature dependency.

That circuit arrangement draws the control voltage Us directly from the operating current of the LED light source. For use, for example, in a desk lamp or similar applications, it can be advantageous to implement the control in this way with a simple potentiometer, as shown in FIG. 1.

In an alternative example, it is possible for the gate terminal 91 to remain floating in the form of a farther pin of the LED component and for the control voltage to be specified from outside, for example by a digital potentiometer controlled via DMX or Dali interfaces.

In such an example, the elements shown in FIG. 1 except for the voltage source U and the voltage divider 5, 6, as indicated by the frame 200, are in the form of a module and arranged in a housing which, in addition to having connections for the voltage supply U, also has a further connection for application of the control potential. It is, of course, also possible for two further connections for application of the control voltage Us to be provided.

Figure 2:
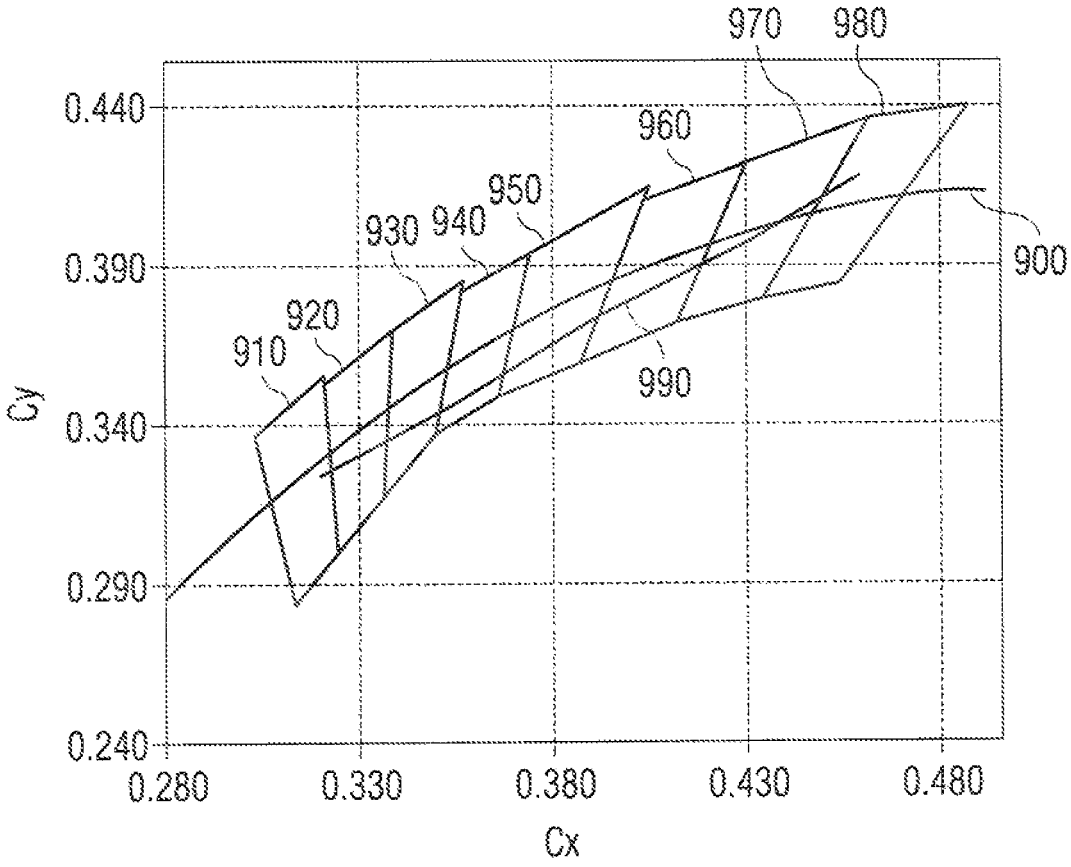
FIG. 2 is a detail of the CIE standard chromaticity diagram showing a line along which the device is controllable.

FIG. 2 shows a detail of the CIE standard chromaticity diagram in the region of the color location coordinates x between 0.28 and 0.48 and in the region of the color location coordinates y between 0.24 and 0.44. The line 900 identifies the so-called "white curve" of a Planckian black-body radiator at different temperatures. Those temperatures are also known as the color temperature. The regions 910, 920, 930, 940, 950, 960, 970, 980 are color temperature regions of a so-called "ANSI binning system" which divides color temperatures of white into classes. The region 910 corresponds to 6500K, which is cold-white light. The region 920 corresponds to 5700K, which is still also to be regarded as cold-white light. The region 930 corresponds to 5000K, which is to be regarded as neutral-white light. The region 940 corresponds to 4500K. The region 950 corresponds to 4000K. The region 960 corresponds to 3500K. The region 970 corresponds to 3000K. The region 980 corresponds to 2700K. Those regions 940, 950, 960, 970, 980 are to be regarded as warm-white light.

The line 990, determined by simulation assuming typical LED characteristics for the light source, is followed on variation of the control voltage Us at an operating temperature of 75 degrees Celsius. It can be seen that the curve followed in the Cx-Cy space lies completely within the regions 910, 920, 930, 940, 950, 960, 970, 980 of the ANSI binning system. The color temperature varies between 7000K and 2700K. The color rendering index CRI always remains above CRI>80, in the warmer region even above CRI>90.

Figure 3:
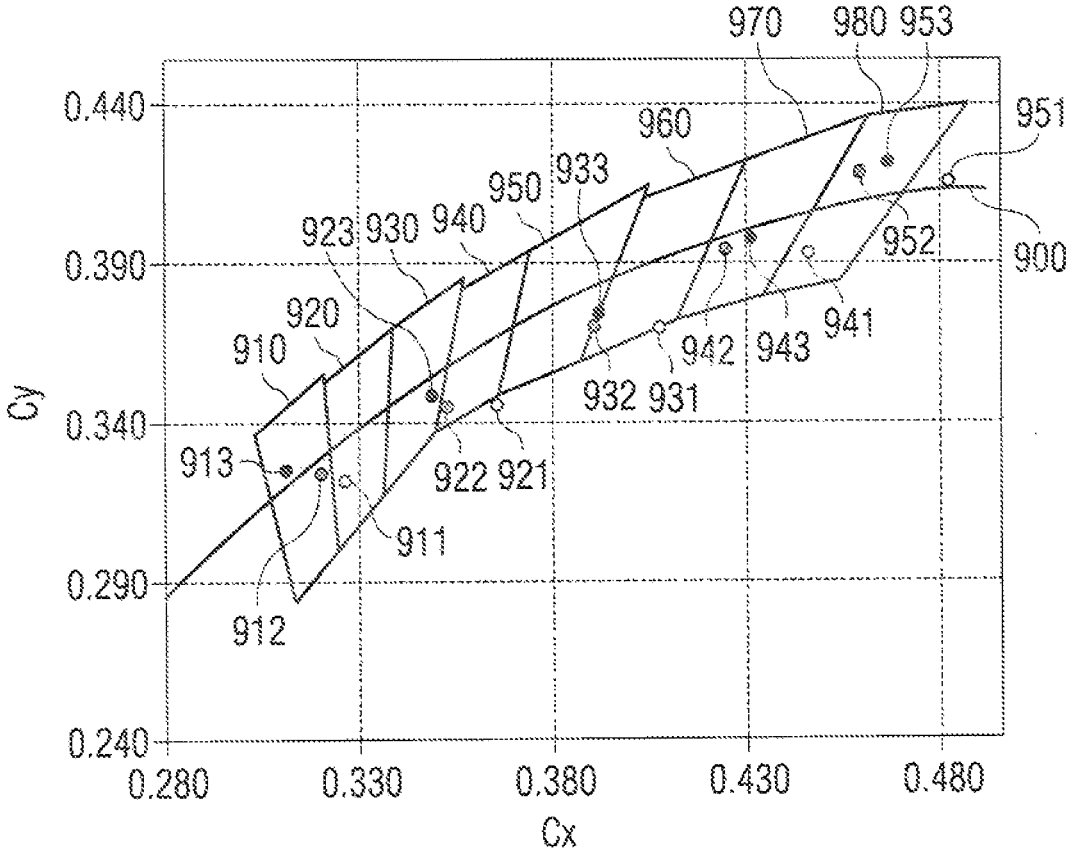
FIG. 3 is a detail of the CIE standard chromaticity diagram showing color locations of the light emitted by the device with stabilization and by a comparison device without stabilization.

FIG. 3 shows the stabilizing action of the circuit arrangement having the PTC resistance element 4. FIG. 3 shows a detail of the CIE standard chromaticity diagram in the region of the color location coordinates x between 0.28 and 0.48 and in the region of the color location coordinates y between 0.24 and 0.44. The line 900 identifies the white curve. The regions 910, 920, 930, 940, 950, 960, 970, 980 of the ANSI binning system are also shown.

The blank markings 911, 921, 931, 941, 951 are the color locations of a comparison circuit arrangement without color stabilization, that is to say without a PTC resistance element, at a temperature of 25 degrees Celsius, corresponding to the state directly after the light source is switched on. The different markings 911, 921, 931, 941, 951 here correspond to different color locations when the color temperature of the mixed light emitted by the circuit arrangement is changed.

The hatched markings 912, 922, 932, 942, 952 show the color locations of the mixed light in the case of a circuit arrangement having color location stabilization with a PTC resistance element 4 at a temperature of 25 degrees Celsius, corresponding to the state directly after the light source is switched on. The different markings 912, 922, 912, 942, 952 here correspond to different color locations when the color temperature of the mixed light emitted by the circuit arrangement changes as a result of a change in the control voltage Us.

The filled markings 913, 923, 933, 943, 953 show the color locations stabilized with the PTC resistance element 4 at a temperature of 75 degrees Celsius for the circuit arrangement both without and with color location stabilization.

The group of markings 911, 912, 913 shows the color locations for two circuit arrangements with or without a PTC resistance element 4 which have been adjusted such that at 75 degrees Celsius they radiate light having the sane color location 913. In the case of the circuit arrangement without a PTC resistance element 4, however, the deviation of the color location 911 at 25 degrees Celsius from the color location 913 is significantly greater than the deviation of the color location 912 at 25 degrees Celsius in the case of the circuit arrangement with a PTC resistance element 4. In other words: in the case of a circuit arrangement having a PTC resistance element 4, the color location drifts to a lesser extent in the event of a change in temperature.

That effect can also be observed for the other groups of markings. The group of markings 921, 922, 923 exhibits that effect, as do the groups of markings 931, 932, 933 and 941, 942, 943. The group of markings 951, 952, 953 exhibits that effect in the case of warm-white light.

The difference between the color locations 912, 922, 932, 942, 952 of the stabilized circuit arrangement after switch-on, that is to say at 25 degrees Celsius, and the color locations 913, 923, 933, 943, 953 after the operating temperature has been reached, that is to say at 75 degrees Celsius, is very small. Especially in the warm-white and neutral-white regions, the differences in color temperature in terms of the color location coordinates remain in the region of less than 0.01. That very small difference is due to the PTC resistance element 4.

FIGS. 4 and 5 show once again the control of the third LED 31 in the third branch via the control voltage Us using a P-channel MOSFET or an N-channel MOSFET.

Figure 4:
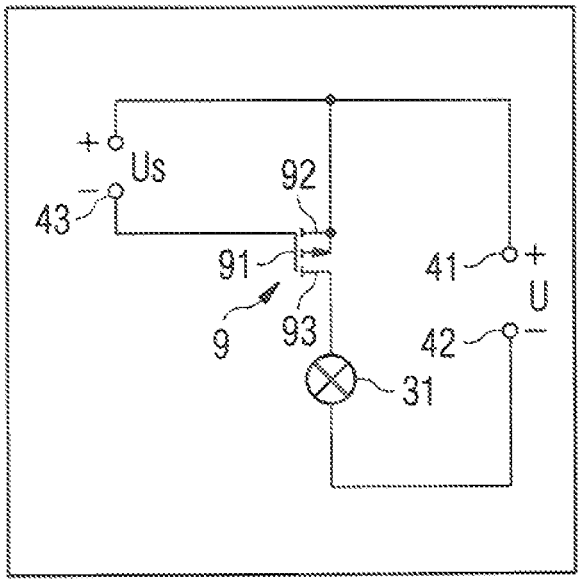
FIG. 4 shows the circuit of a P-channel MOSFET.

FIG. 4 shows a P-channel MOSFET as the semiconductor light source control element 9, the drain terminal 93 of which is connected to the third diode 31. The supply voltage U is applied between the source terminal 92 and the third diode 31. The control voltage Us is applied between the source terminal 92 and the gate terminal 91. When a control voltage sufficient to enable the branch, for example Us=10V at a supply voltage U=20V is applied, the third diode 31 emits light. When the control voltage Us disappears, for example Us=0V at U=20V, the P-channel MOSFET as the semiconductor light source control element 9 is closed, that is to say its resistance approaches infinity. The control voltage Us can be variable between 0V and 10V.

The P-channel MOSFET as the semiconductor light source control element 9 is very suitable for use in a module which is provided with only one further connection or pin for application of the control potential. The supply voltage can be applied in respect of the pins 41, 42, the reference potential being applied to the latter. Since the supply potential is already applied via the pin 41 to the source terminal 92 of the P-channel MOSFET 9, only one further pin 43, which is connected to the gate terminal 91, is necessary to set the gate source voltage. The module should have a supply voltage of a level comparable to that of the gate source voltage to avoid external control voltages. If an external control voltage is desirable, this can also be realized by implementing the gate terminal 91 of the MOSFET as a floating gate terminal.

Figure 5:
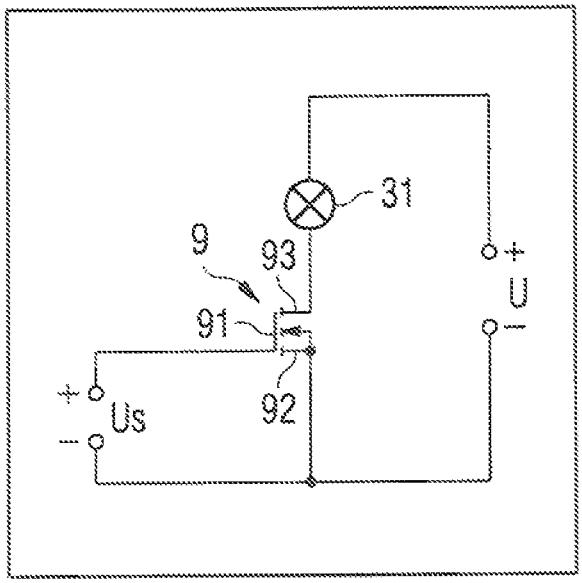
FIG. 5 shows the circuit of an N-channel MOSFET.

In the latter case, an N-MOSFET would be more suitable, as shown in FIG. 5, because the control voltage Us is not dependent upon the supply voltage U.

FIG. 5 shows, as an example of a semiconductor light source control element 9, an N-channel MOSFET, the drain terminal 93 of which is connected to the third diode 31. The supply voltage U is applied between the source terminal 92 and the third diode 31. The control voltage Us is applied between the source terminal 92 and the gate terminal 91. When a control voltage sufficient to enable the branch, for example, Us=10V at 15-20V is applied, the third diode 31 emits light. When the control voltage disappears, for example. Us=0V and U=20V, the MOSFET is closed, that is to say its resistance approaches infinity.

The invention claimed is:

1. An optoelectronic device that radiates mixed light comprising:

a first semiconductor light source having a first light-emitting diode which, in operation, radiates light in a first wavelength range at a first intensity, the first wavelength range and/or the first intensity having a first temperature dependency;

a second semiconductor light source having a second light-emitting diode which, in operation, radiates light in a second wavelength range at a second intensity, the first and the second wavelength ranges being different from one another and the second wavelength range and/or the second intensity having a second temperature dependency which is different from the first temperature dependency;

a third semiconductor light source having a third light-emitting diode which, in operation, radiates light in a third wavelength range at a third intensity;

a resistance element having a temperature-dependent electrical resistance, and only one semiconductor light source control element, wherein the only one semiconductor light source control element only controls the intensity of the third semiconductor light source;

wherein a parallel circuit is formed with a first series circuit having the resistance element and the first semiconductor light source in a first branch of the parallel circuit, the second semiconductor light source in a second branch of the parallel circuit and a second series circuit having the third semiconductor light source and the only one semiconductor light source control element in a third branch of the parallel circuit, and wherein the first, second and third branches are connected to a common connection point for each of both sides of the parallel circuit, and the only one semiconductor light source control element is not situated in the first or second branches of the circuit.

2. The device according to claim 1, wherein the first temperature dependency is less than the second temperature dependency, and the resistance element is a resistance element having a positive temperature coefficient.

3. The device according to claim 2, wherein the semiconductor light source control element in a first state blocks flow of current through the third branch and in a second state allows flow of current through the third branch.

4. The device according to claim 1, wherein the first temperature dependency is greater than the second temperature dependency, and the resistance element is a resistance element having a negative temperature coefficient.

5. The device according to claim 4, wherein the only one semiconductor light source control element in a first state blocks flow of current through the third branch and in a second state allows flow of current through the third branch.

6. The device according to claim 1, wherein the only one semiconductor light source control element in a first state blocks flow of current through the third branch and in a second state allows flow of current through the third branch.

7. The device according to claim 6, which can be switched over discretely between the first and second states.

8. The device according to claim 6, wherein flow of current through the third branch is continuously changeable.

9. The device according to claim 1, wherein the semiconductor light source control element comprises a transistor to which a control voltage (Us) can be applied.

10. The device according to claim 9, wherein the transistor is in the form of an N-channel MOSFET or a P-channel MOSFET.

11. The device according to claim 10, further comprising a potentiometer to set the control voltage (Us).

12. The device according to claim 10, further comprising a voltage divider to set the control voltage (Us).

13. The device according to claim 9, further comprising a potentiometer to set the control voltage (Us).

14. The device according to claim 13, further comprising a voltage divider to set the control voltage (Us).

15. The device according to claim 9, further comprising a voltage divider to set the control voltage (Us).

16. The device according to claim 1, wherein the mixed light is warm white in one of the states and cold white in the other state.

17. The device according to claim 1, wherein the third semiconductor light source emits blue light.

18. The device according to claim 1, in the form of a module having connections for application of a supply voltage (U).

19. The device according to claim 18, comprising a connection for application of a potential for actuating the only one semiconductor light source control element.

20. An optoelectronic device that radiates mixed light comprising:

a first semiconductor light source having a first light-emitting diode which, in operation, radiates light in a first wavelength range at a first intensity, the first wavelength range and/or the first intensity having a first temperature dependency, a second semiconductor light source having a second light-emitting diode which, in operation, radiates light in a second wavelength range at a second intensity, the first and the second wavelength ranges being different from one another and the second wavelength range and/or the second intensity having a second temperature dependency different from the first temperature dependency, a third semiconductor light source source having a third light-emitting diode which, in operation, radiates light in a third wavelength range at a third intensity, a resistance element having a temperature-dependent electrical resistance, a semiconductor light source control element that controls the intensity of the third semiconductor light source, wherein the semiconductor light source control element is the only semiconductor light source control element, and a parallel circuit comprising a first series circuit having the resistance element and the first semiconductor light source in a first branch of the parallel circuit, the second semiconductor light source in a second branch of the parallel circuit and a second series circuit having the third semiconductor light source and the semiconductor light source control element in a third branch of the parallel circuit, wherein the semiconductor light source control element is not situated in the first or second branches of the circuit, wherein the first temperature dependency is less than the second temperature dependency and the resistance element is a resistance element having a positive temperature coefficient or wherein the first temperature dependency is greater than the second temperature dependency and the resistance element is a resistance element having a negative temperature coefficient.

21. An optoelectronic device that radiates mixed light comprising:

a first semiconductor light source having a first light-emitting diode which, in operation, radiates light in a first wavelength range at a first intensity, the first wavelength range and/or the first intensity having a first temperature dependency, a second semiconductor light source having a second light-emitting diode which, in operation, radiates light in a second wavelength range at a second intensity, the first and the second wavelength ranges being different from one another and the second wavelength range and/or the second intensity having a second temperature dependency different from the first temperature dependency, a third semiconductor light source having a third light-emitting diode which, in operation, radiates light in a third wavelength range at a third intensity, a resistance element having a temperature-dependent electrical resistance, a semiconductor light source control element that controls the intensity of the third semiconductor light source, and a parallel circuit consisting of three branches, wherein a first branch consists of the resistance element and the first semiconductor light source, a second branch consists of the second semiconductor light source, and a third branch consists of the third semiconductor light source and the semiconductor light source control element.

* * * * *